US006699012B1

(12) United States Patent
Lin

(10) Patent No.: US 6,699,012 B1
(45) Date of Patent: Mar. 2, 2004

(54) PRESSURE-INCREASING DEVICE DRIVEN BY LIQUID

(76) Inventor: Po Hung Lin, No. 6, Lane 255, Sec. 2, Meitsuen Rd., Taichung (TW)

( * ) Notice: Subject to any disclaimer, the term of this patent is extended or adjusted under 35 U.S.C. 154(b) by 0 days.

(21) Appl. No.: 10/246,683

(22) Filed: Sep. 19, 2002

(51) Int. Cl.[7] ..... F04D 29/24
(52) U.S. Cl. ..... 415/202; 415/206; 415/72
(58) Field of Search ..... 415/72, 73, 75, 415/221, 176, 177, 202, 206; 416/176, 177; 417/423.1, 423.3, 423.14, 366; 440/38, 40, 41, 42, 43; 114/55.5, 55.56

(56) References Cited

U.S. PATENT DOCUMENTS 5,332,355 A * 7/1994 Lyda, Jr. ..... 415/74

* cited by examiner

*Primary Examiner*—Edward K. Look
*Assistant Examiner*—Kimya N McCoy
(74) *Attorney, Agent, or Firm*—Troxell Law Office PLLC

(57) ABSTRACT

A pressure-increasing device driven by liquid includes a body, a power unit, a drive unit and a bottom base. The body has a housing provided with an inner tube in the interior, and a water passage formed between the housing and the inner tube. A drive unit is positioned at the bottom of the body, having a plate body provided thereon with a plurality of centrifugal blades. A plurality of extension wings are respectively disposed at preset locations of the outer ends of the centrifugal blades. Each extension wing extends outward to a preset position in the water passage of the body for holding up the water thereon and pushing it upward by the driving force produced by its rotation to produce a powerful pressure-increasinng force for pushing water easily outward.

8 Claims, 5 Drawing Sheets

PRESSURE-INCREASING DEVICE DRIVEN BY LIQUID

BACKGROUND OF THE INVENTION

This invention relates to a pressure-increasing device driven by liquid, particularly to one provided with a plurality of extension wings preset in number around the periphery of the plate body of a drive unit for holding and pushing upward flowing water to increase pressure so that water may flow easily outward.

Generally, a sinking pump is employed to pump the water of an aquarium into a filtering tank for filtering impurities therein, or a water-pumping motor is used to pump water into the water-reserving tank on the top of a high building. The operating principle of either the sinking pump or the water-pumping motor is to employ a motor and a blade or a gear to push water outward by means of a centrifugal force to enable water to produce a pressure-increasing force and be easily pushed upward to a high level for use.

However, the conventional centrifugal blades are simply structured so they can hardly produce a great pressure-increasing force. In this case, the horsepower of a motor has to be increased in order to pump water from a low level to a high level through a long distance, thus increasing cost, making great noise and taking a large space.

SUMMARY OF THE INVENTION

The objective of the invention is to offer a pressure-increasing device driven by liquid, provided with a plurality of extension wings preset in number at proper positions of the outer ends of the centrifugal blades on the plate body of a drive unit. The extension wings respectively extend to the preset location in the middle of the water passage of a body for holding and pushing upward the water thereon to produce a powerful pressure-increasing force for forcefully pushing the water outward by a driving force produced by rotation of the extension wings.

Another objective of the invention is to offer a pressure-increasing device driven by liquid, in which the housing and the inner tube of a body, and the plural ribs as well as the communicating water passage between the housing and the inner tube are all formed integral, able to reinforce its structure and lower producing cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
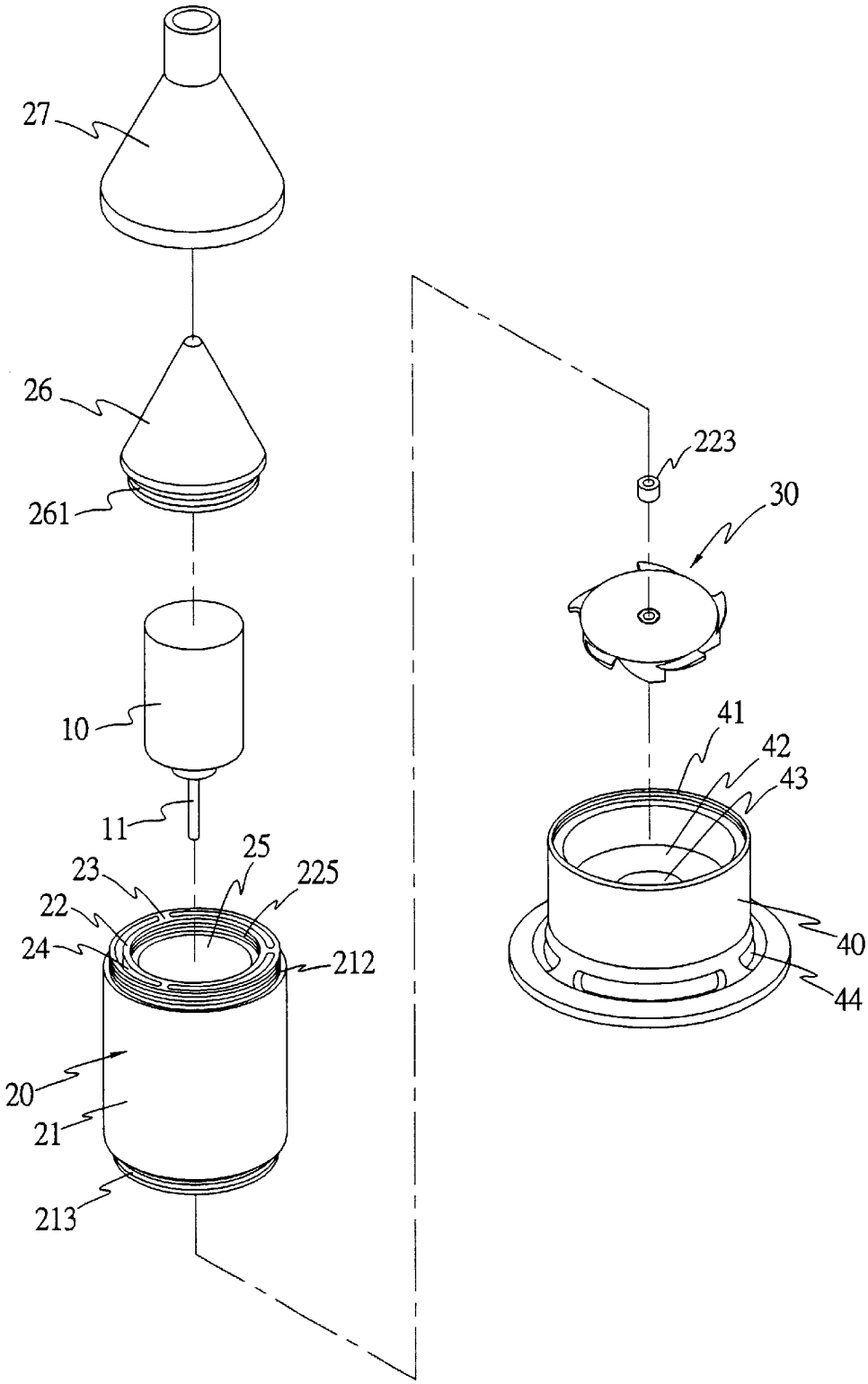
FIG. 1 is an exploded perspective view of a pressure-increasing device driven by liquid in the present invention.
Figure 2:
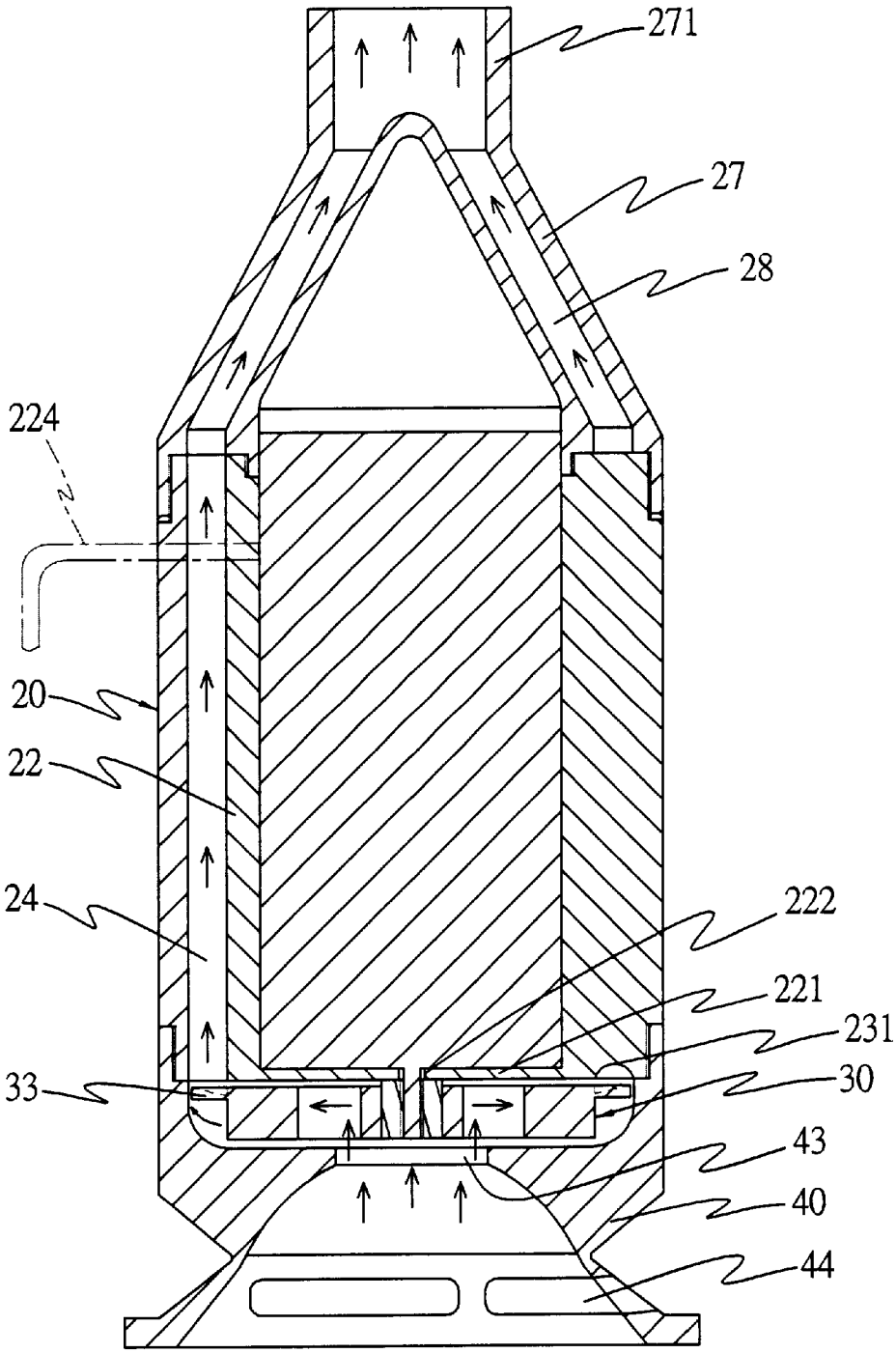
FIG. 2 is a cross-sectional view of the pressure-increasing device driven by liquid, illustrating a condition of water flowing there in the present invention.

A preferred embodiment of a pressure-increasing device driven by liquid in the present invention, as shown in FIGS. 1 and 2, includes a power unit 10, a body 20, a drive unit 30 and a bottom base 40 as main components combined together.

The power unit 10 is a motor in this preferred embodiment, having a spindle 11 extending outward from the lower end.

Figure 3:
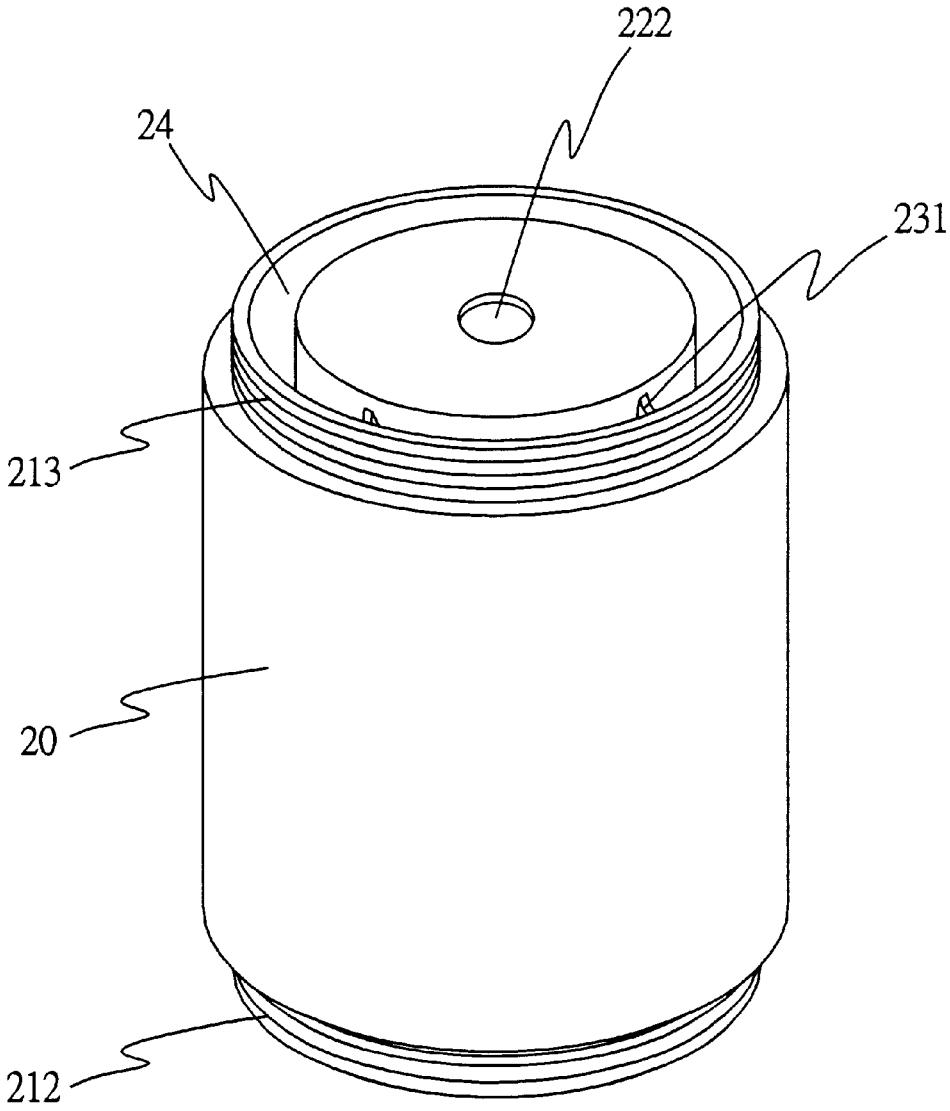
FIG. 3 is a rear perspective view of the pressure-increasing device driven by liquid in the present invention.

The body 20 has its housing 21 fitted inside with a concentric inner tube 22. The housing 21 and the inner tube 22 are connected together by means of three ribs 23, having an up-and-down through water passage 24 formed between the housing 21 and the inner tube 22. The housing 21, the inner 22 and the three ribs 23 are all formed integral. Further, each rib 23 is provided with an arcuate recess 231 in the bottom, as shown in FIG. 3. The inner tube 22 has a hollow interior for receiving the power unit 10, which has its spindle inserted out of the through hole 222 of the bottom plate 221 of the inner tube 22 and fitted around with a gasket 223. The electric wire 224 of the power unit 10 is inserted through the inner tube 22 and one of the ribs 23 and protrudes out of the housing 21. The inner tube 22 has its upper end provided with female threads 225 to be screwed together with the male threads 261 at the bottom end of an upper cover 26 for closing up the power unit 10, with the upper cover 26 having a cone-shaped upper portion. Besides, the housing 21 has its upper end formed with male threads 212 to be screwed together with a fit member 27, which is a tapered conical body having a hollow interior and has a water-exhausting pipe 271 at the front end. A conical water-exhausting passage 28 is formed between the inner surface of the fit member 27 and the outer surface of the upper cover 26 with a preset interval. Further, the body 20 has its bottom end formed with male threads 213.

Figure 4:
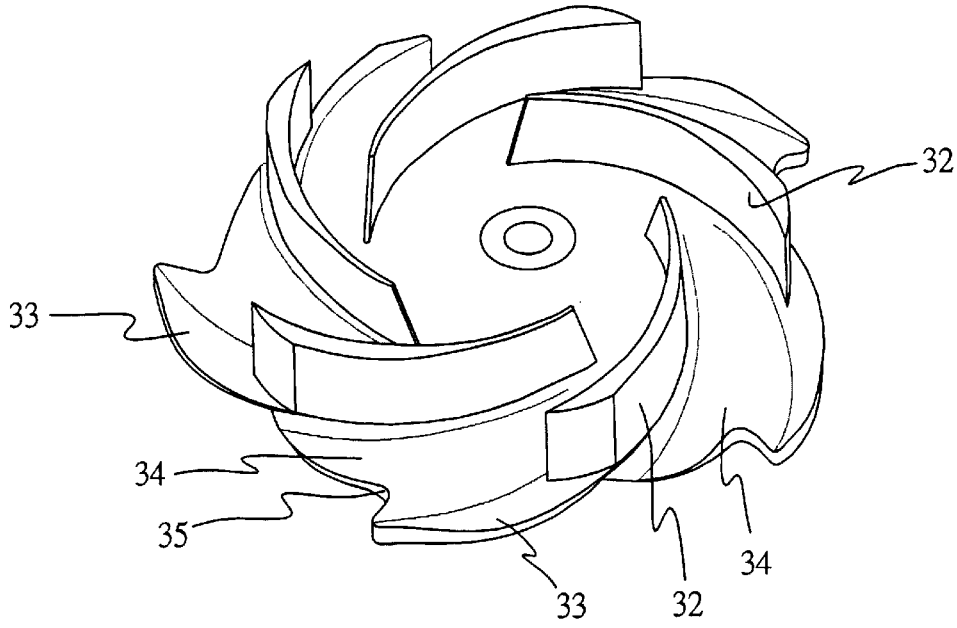
FIG. 4 is a perspective view of a drive unit in the invention.
Figure 5:
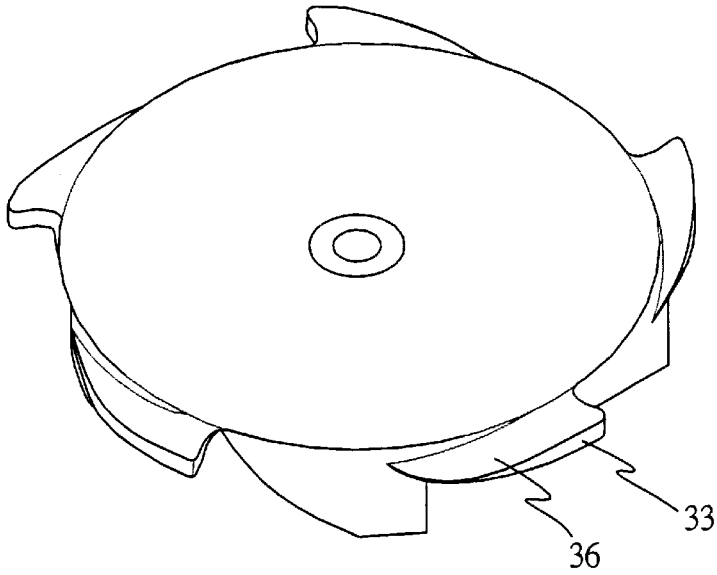
FIG. 5 is a rear perspective view of the drive unit in the present invention.

The drive unit 30 is positioned at the bottom of the body 20 and connected axially with the spindle 11 of the power unit 10. The drive unit 30 has a plate body 31 provided thereon with a plurality of centrifugal blades 32. The plate body 31 has a plurality of extension wings 33 respectively disposed at the outer end and in the extending direction of each centrifugal blade 32, as shown in FIGS. 4 and 5, and each extension wing 33 extends outward to reach a location outside the middle of the water passage 24 of the body 20, as shown in FIG. 2. The plate body 31 further has a plurality of recessed guide grooves 34 respectively provided between every two blades 32 and extending outward and gradually growing wider and deeper, as shown in FIG. 4. Then, each guide groove 34 is provided at the outer end with a water-guiding notch 35 adjacent to the end of the extension wing 33. In addition, each extension wing 33 has its rear side formed with a slanting surface 36 gradually growing thicker toward the end, as shown in FIG. 5.

The bottom base 40 has its upper end formed with female threads 41 to be screwed together with the male threads 213 at the bottom of the body 20 and is provided with a central hollow 42 in the center for receiving the drive unit 30 therein. The center hollow 42 is bored at the bottom with a through hole 43 communicating with plural water-sucking holes 44 bored around the periphery of the bottom of the bottom base 40.

In using, as shown in FIG. 2, water is sucked in through the water-sucking holes 44 of the bottom base 40 to flow to the drive unit 30 via the through hole 43. Then, the water is pressed by the centrifugal blades 32 of the drive unit 30 to push and rotate the peripheral positions of the extending wings 33, which simultaneously push the water to flow upward along the up-and-down water through passage 24 of the body 20. After water is guided and gathered together by the conical water-exhausting passage 28 between the fit member 27 and the upper cover 26, it is forced to flow out of the water-exhausting, pipe 271 at the front end of the fit member 27.

Figure 6:
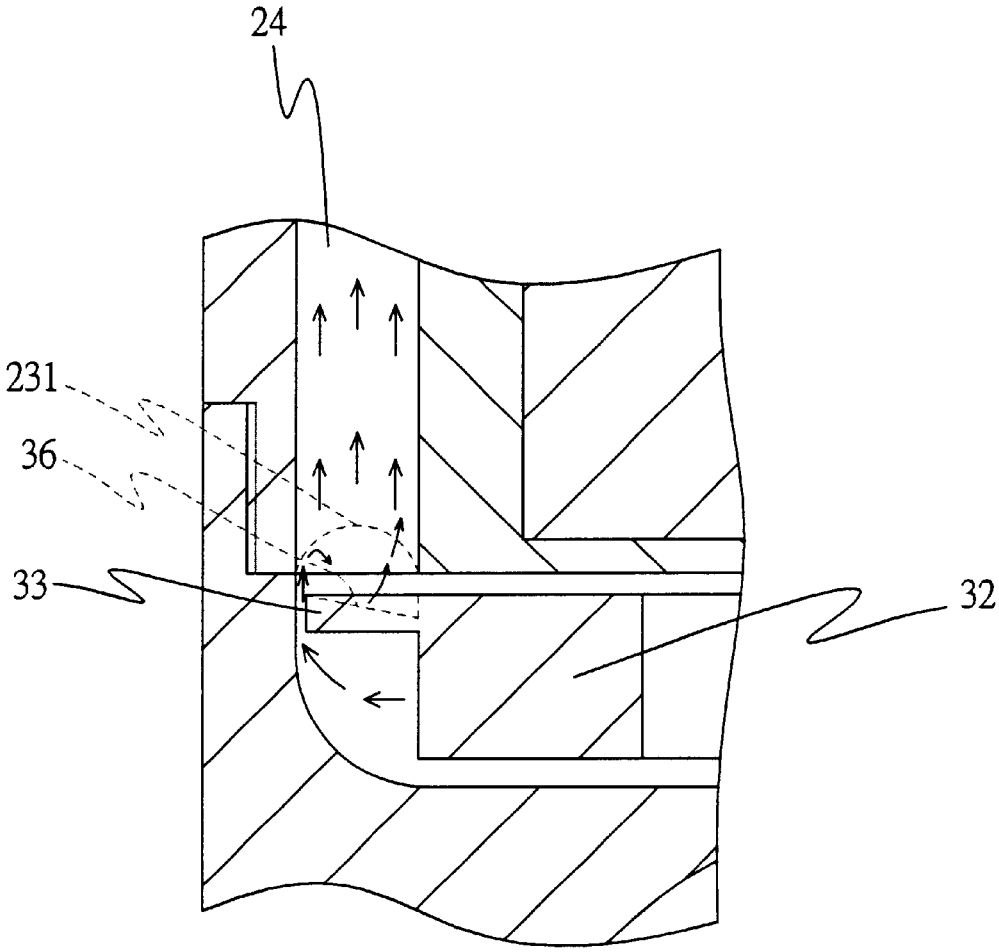
FIG. 6 is a cross-sectional view of the extension wings holding and pushing upward the water thereon in the present invention.

Specifically, the plate body 31 of the drive unit 30 has the plurality of extension wings 33 respectively disposed at the outer end and in the extending direction of each centrifugal blade 32. Each extension wing 33 extends outward to reach a position outside the middle of the water passage 24 of the body 20, as shown in FIGS. 2 and 6, so as to let the extension wings 33 able to hold up the water in the water passage 24 to overcome the force of gravity. Meanwhile, water is pushed upward by the extension wings 33 and produces a powerful pressure-increasing force by a driving force produced by the rotation of the slanting surfaces 36 on the rear side of the extension wings 33.

The plate body 31 of the drive unit 30 has its surface provided with the plurality of recessed guide grooves 34 respectively positioned between every two centrifugal blades 32 to extend outward and gradually growing broader and deeper. These guide grooves 34 help to guide water to flow in definite directions to increase the amount and smoothness of water flowing, and the water guiding notches 35 respectively formed at the outer end of each guide groove 34 and positioned near the extension wings 33, 34 also help the water to flow upward to be pushed forward by the extension wing 33. In short, each component in this invention is designed to conform to the characteristic of liquid flowing to let flowing water pushed forward orderly and smoothly.

Moreover, the housing 21, the inner tube 22, the three ribs 23 between the housing 21 and the inner tube 22, and the up-and-down-through water passage 24 of the body 20 are all formed integral, able to reinforce structure, diminish size and lower producing cost. Besides, the arcuate recess 231 provided in the bottom of the ribs 23 and positioned near the extension wings 33 are able to receive rotating water and then separately guide it to flow into the water passage 24 smoothly.

Further, the conical water-exhausting passage 28 formed between the fit member 27 and the upper cover 26 gathers the flowing-up water to reach the water-exhausting pipe 271 at the front end of the fit member 27 and then presses the water therein by its conical structure to increase a force of water exhausting.

The pressure-increasing device driven by liquid in the present invention may serve as a pump to be applied to an aquarium or a pool, and with its characteristic of water entering and water exhausting in a same direction, such a pressure-increasing device may also serve as a propeller to be applied to a boat or a float.

While the preferred embodiment of the invention has been described above, it will be recognized and understood that various modifications may be made therein and the appended claims are intended to cover all such modifications that may fall within the spirit and scope of the invention.

I claim:

1. A pressure-increasing device driven by liquid comprising:

a body having a housing, said housing fitted with a concentric inner tube in the interior, an up-and-down through water passage formed between said housing and said inner tube, said inner tube receiving a power unit, said power unit having its spindle inserted through the bottom plate of said inner tube: and a drive unit positioned at the bottom of said body, said drive unit connected axially with said spindle of said power unit, said drive unit having a plate body, said plate body provided thereon with a plurality of centrifugal blades, a plurality of extension wings preset in number respectively provided at preset locations of the outer ends of said centrifugal blades, each said extension wing extending to a preset position of the middle of a water passage of said body.

2. The pressure-increasing device driven by liquid as claimed in claim 1, wherein said extension wings extend outward in the extending direction of said centrifugal blades.

3. The pressure-increasing device driven by liquid as claimed in claim 1, wherein each said extension wing has its rear side formed with a slanting surface extending to the end and gradually growing thicker and thicker.

4. The pressure-increasing device driven by liquid as claimed in claim 1, wherein said plate body of said drive unit has a plurality of recessed guide grooves respectively provided between every two of said centrifugal blades and extending outward and gradually growing wider and deeper, having a water-guiding notch formed at the outer end of each said recessed guide groove.

5. The pressure-increasing device driven by liquid as claimed in claim 4, wherein said water-guiding notch is located near the end of each said extension wing.

6. The pressure-increasing device driven by liquid as claimed in claim 1, wherein said housing and said inner tube are connected together by plural ribs positioned therebetween, and all of them are formed integral.

7. The pressure-increasing device driven by liquid as claimed in claim 6, wherein each said rib has an arcuate recess provided at the bottom and positioned near said extension wing.

8. The pressure-increasing device driven by liquid as claimed in claim 1, wherein said inner tube has its upper end pivotally combined with an upper cover, and said housing has its upper end pivotally combined with a fit member having a water-exhausting pipe at its front end, and a conical water-exhausting passage is formed between the inner side of said fit member and the outer side of said upper cover with a preset interval.

* * * * *